US006356009B1

(12) United States Patent
Coushaine et al.

(10) Patent No.: US 6,356,009 B1
(45) Date of Patent: Mar. 12, 2002

(54) LAMP WITH A SLIP ON ENVELOPE RETAINER AND CLAMP RING

(75) Inventors: Charles M. Coushaine, Rindge; Mark A. Lukkarinen, Merrimack, both of NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/260,402

(22) Filed: Mar. 1, 1999

(51) Int. Cl.[7] ..... H01J 5/48; H01J 5/50

(52) U.S. Cl. ..... 313/318.01; 313/318.02; 313/318.09

(58) Field of Search ..... 313/318.01, 318.02, 313/318.03, 318.07, 318.09, 318.1

(56) References Cited

U.S. PATENT DOCUMENTS

| | | | | |
|---|---|---|---|---|
| 2,653,304 A | * | 9/1953 | Wadsworth | 439/738 |
| 4,316,120 A | * | 2/1982 | Cotman et al. | 315/58 |
| 4,607,192 A | * | 8/1986 | Billing et al. | 313/579 |
| 5,428,261 A | * | 6/1995 | Wittig et al. | 313/318.1 |
| 5,550,422 A | * | 8/1996 | Sulcs et al. | 313/318.04 |
| 5,627,428 A | * | 5/1997 | Helbig et al. | 313/318.01 |
| 6,031,323 A | * | 2/2000 | Behr et al. | 313/318.01 |

FOREIGN PATENT DOCUMENTS

| | | |
|---|---|---|
| EP | 0 930 635 A2 | 7/1999 |
| GB | 1032163 | 6/1966 |
| WO | WO 96/20493 | 7/1996 |

* cited by examiner

*Primary Examiner*—Vip Patel
*Assistant Examiner*—Kevin Quarterman
(74) *Attorney, Agent, or Firm*—William E. Meyer

(57) ABSTRACT

A lamp, whether HID or other, can be conveniently held by with slip ring that compresses flexible arms against the lamp end. The arms are formed to conform on and inner side with and exterior portion of the lamp. On their exterior side of the arms are formed to mate in compression with a slip ring. By tapering the arms with respect the slip ring, and increasing pressure can be induced that flexes the arms to hold the lamp in place. The slip ring can be further formed to bind the slip ring with three clamp arms, and thereby resist disengagement of the structure once assembly is completed. The result is a securely held lamp accurately held by inexpensive parts adaptable to rapid machine assembly.

13 Claims, 5 Drawing Sheets

LAMP WITH A SLIP ON ENVELOPE RETAINER AND CLAMP RING

TECHNICAL FIELD

The invention relates to electric lamps and particularly to electric vehicle lamps. More particularly the invention is concerned with a support for a double ended arc discharge lamp for use in a vehicle headlamp.

BACKGROUND ART

High intensity discharge (HID) lamps have recently been introduced in automotive headlamps. Secure and accurate location of lamp is important in providing a proper vehicle headlamp beam. Equally, important is the cost of manufacture and assembly. Rapid assembly by machines is clearly required if millions of these highly efficient lamps are to be made practical use of. The holding parts must then be simple to manufacture, simple to assemble, and still highly functional in the difficult environment of a vehicle. There is then a need for a simple, accurate, secure mechanism for holding an HID lamp for use in vehicle headlamp.

DISCLOSURE OF THE INVENTION

A lamp with slip on envelope retainer and clamp ring may be formed with a lamp with an axially extending support region, an envelope retainer and a clamp ring. The envelope retainer has at least one flexible clamp arm having an attached end and a free end and having an interior surface and an exterior surface. The lamp support region is positioned adjacent the interior surface of the clamp arm. The clamp ring is positioned around the support region of the lamp and the clamp arm of the envelope retainer, with an inner wall of the clamp ring pressing the exterior wall of clamp arm to in turn press the interior wall of the clamp arm in contact with the support region to thereby clamp the lamp capsule to the envelope retainer.

BEST MODE FOR CARRYING OUT THE INVENTION

Figure 1:
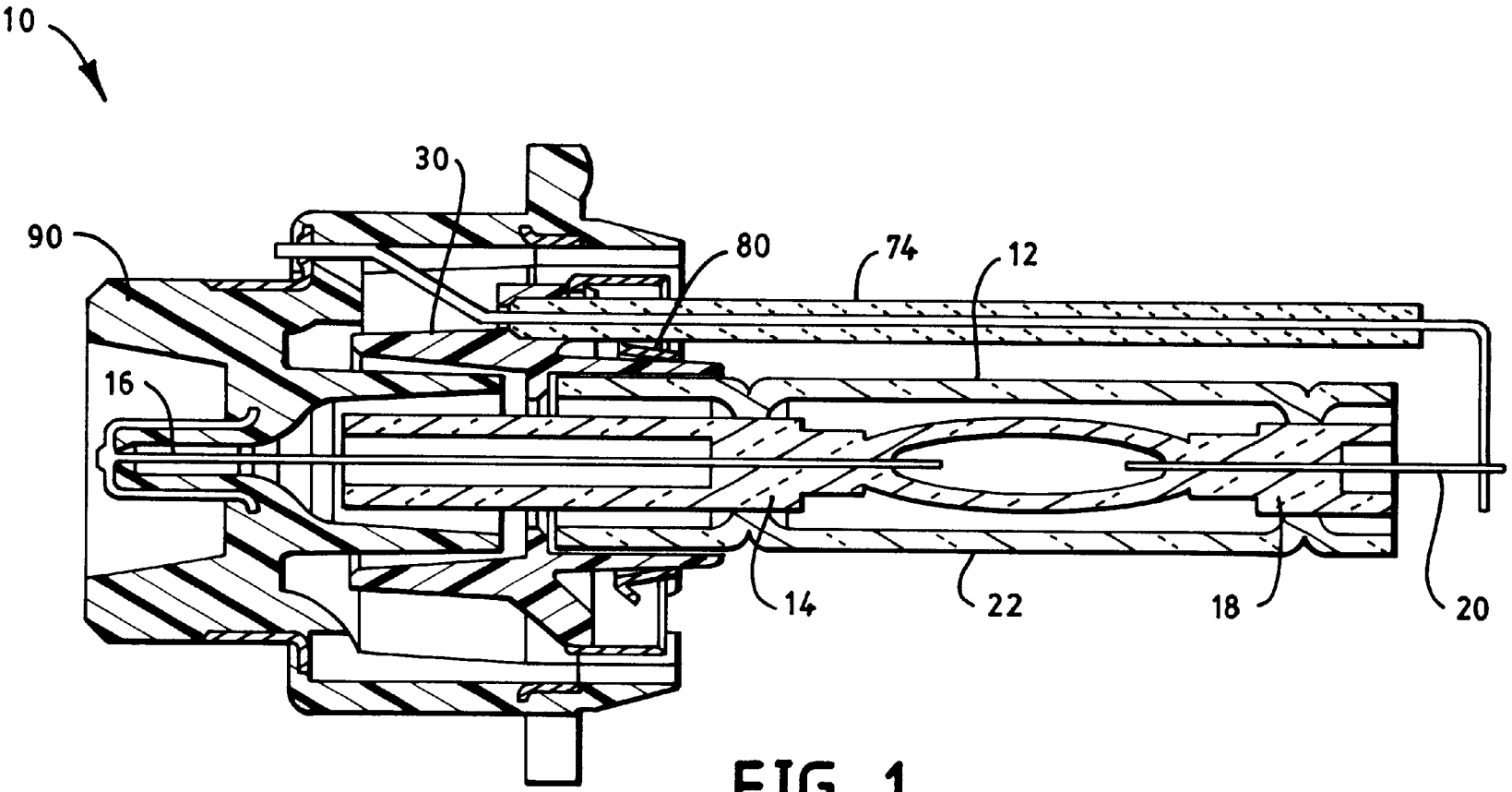
FIG. 1 shows a cross sectional view of a preferred embodiment of a lamp assembly with slip on envelope retainer and clamp ring.

FIG. 1 shows a preferred embodiment of a vehicle lamp 10 with slip on envelope retainer and clamp ring 80. Like reference numbers designate like or corresponding parts throughout the drawings and specification. The vehicle lamp assembly 10 with slip on envelope retainer 30 and clamp ring 80 is assembled from a lamp capsule 12, an envelope retainer 30, a clamp ring 80, and a base 90.

Figure 2:
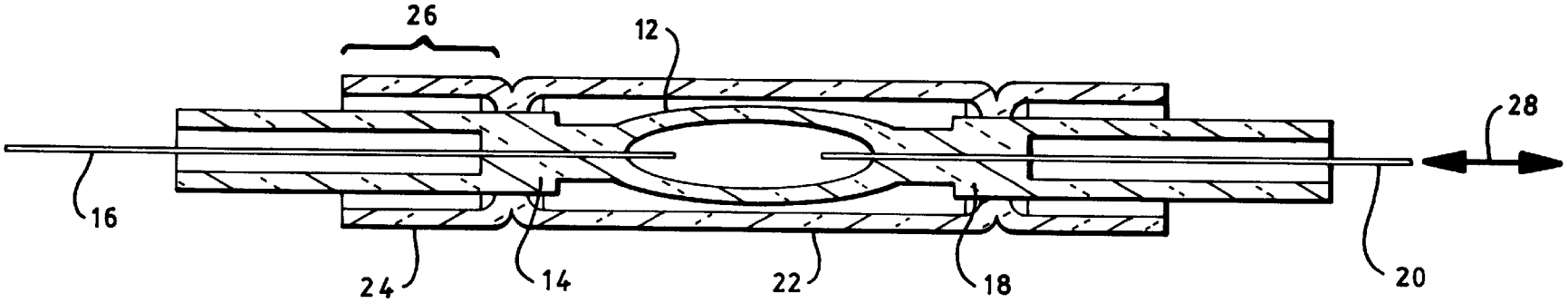
FIG. 2 shows a cross sectional view of a lamp capsule.

FIG. 2 shows a cross sectional view of a lamp capsule. The lamp capsule 12 may be made out of light transmissive material, such as glass or quartz to have the general form of an elongated tube. The lamp capsule 12 has a first end 14, with a first lead 16 extending therefrom. The lamp may have a similar second end 18 with a similar second lead 20 extending therefrom. In the preferred embodiment, the lamp capsule 12 is enclosed in an outer tube 22 that is sealed to the first end 14 and sealed to the second end 18. Extending from the coupling between the first end 14 and the outer tube 22 is a tubular skirt 24 providing a support region 26 extending around the lamp capsule 12. The preferred lamp is a tubular, double ended HID lamp with an axis 28 extending with a circular cross section. It should be understood the outer tube is optional, and the support region 26 referred to herein may equivalently be taken as the exterior portion of the first end 14. Also, while the circular cylindrical form for the support region 26 is preferred, any reasonably regular surface may be used in the support region 26. The second end 18 may be formed similar to the first end 14, or the lamp may also be single ended. While an arc lamp is described, a filamented lamp may also be used.

Figure 3:
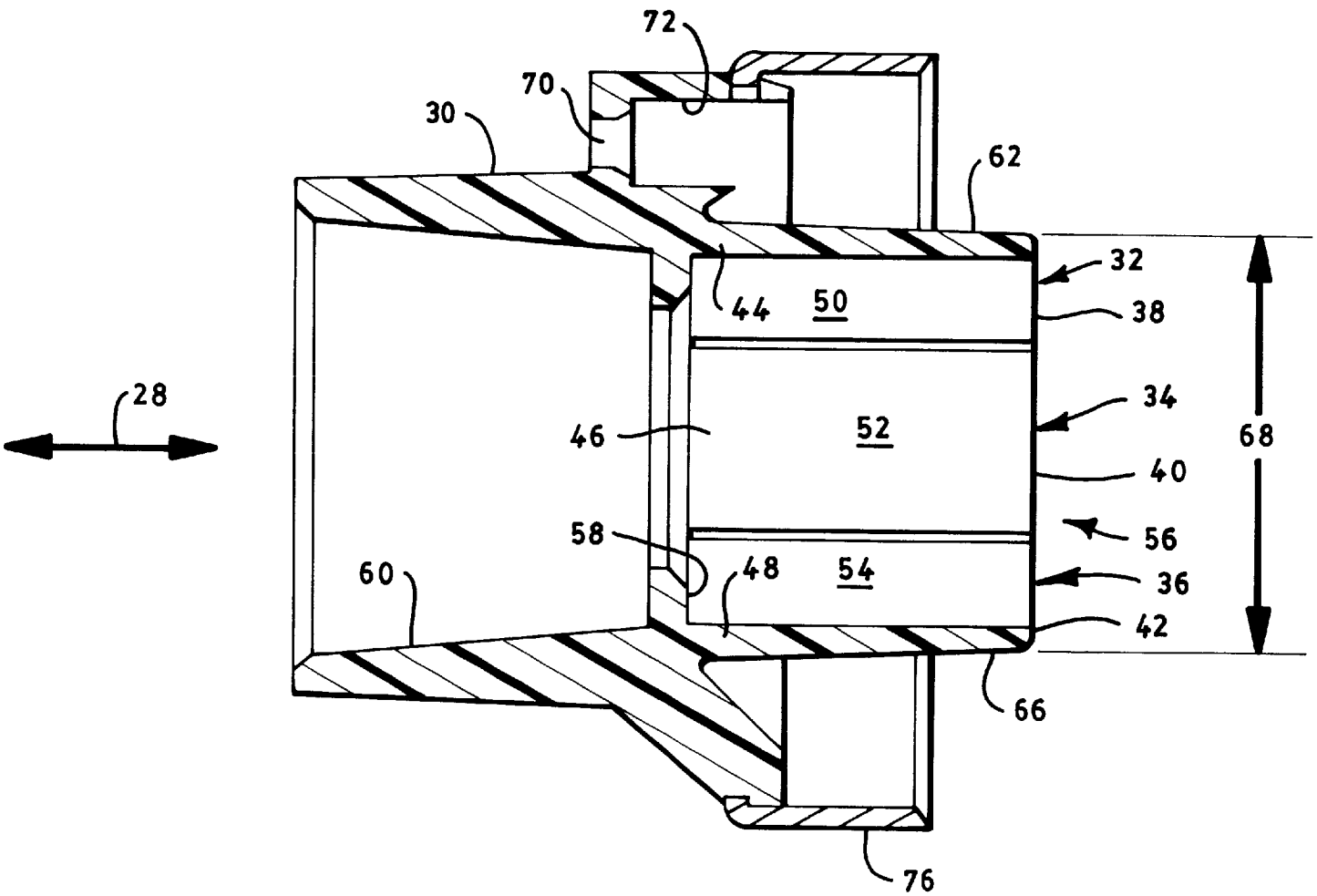
FIG. 3 shows a cross sectional view of an envelope retainer.

FIG. 3 shows a cross sectional view of a envelope retainer 30. The envelope retainer 30 may be made out of a flexible, and compressible high temperature material such as a high temperature resin, such as Amodel or Ultem to have the general form of a tube, one end of which is axially divided into two or more flexible sections, referred to here as clamp arms. The preferred envelope retainer 30 has least three clamp arms 32, 34, 36 each having respectively a free end 38, 40, 42 and an attached end 44, 46, 48. Each clamp arm has respectively an interior surface 50, 52, 44 that is at least partially conformal with a corresponding, and adjacent portion of the lamp support region 56. The interior surfaces 50, 52, 54 collectively define an axially extending cavity 56 sufficiently large to receive the first end 14 and support region 26 (if any) of the lamp capsule 12 therein, such that each clamp arm 32, 34, 36 rests approximately adjacent a corresponding region of the lamp support region 26. The preferred interior surfaces 50, 52, 54 then define a surface at least partially, if not exactly conformal with adjacent portions of the lamp support region 26.

In one preferred embodiment, three clamp arms were formed to define a tubular cavity therebetween. Each of the three clamp arms extended approximately 110 degrees around the lamp axis 28 of the defined cavity, allowing small slits of about 10 degrees to extend between the adjacent clamp arms. Additionally the three clamp arms each had a small expanding taper in extending from its free end to its attached end; thereby collectively providing a conical, albeit nearly cylindrical exterior surface therebetween.

In the preferred embodiment, the envelope retainer 30 includes a portion partially bounding the defined cavity 56, a stop 58 to limit and properly define the insertion depth of the lamp capsule 12 into the defined cavity 56. In the preferred embodiment a circular rim 58 forms the stop portion. The preferred envelope retainer 30 further includes an inner wall portion 60 to defining an interior cavity continuous with the defined cavity 56 to duct the first lamp lead 16 therethrough for electrical and mechanical connection.

Each clamp arm 32, 34, 36 also has an exterior surface 62, 64, 66 (64 is not shown). The exterior surfaces 62, 64, 66 collectively define a perimeter surface. In the preferred embodiment the clamp arms 32, 34, 36 have an increasing exterior diameter 68 in moving from the free ends 38, 40, 42 to the attached ends 44, 46, 48.

Also in the preferred embodiment, the envelop support 30 include a wall 70 to define a guide passage for receiving and directing the second lead 20. The wall 70 may include a coupling end 72 to hold an insulating cover 74 for the second lead 20. The preferred envelope retainer 30 further includes an attachment surface 76 to couple the envelope retainer 30 to other locating and positioning components as may be selected, as is generally known in the art.

Figure 4:
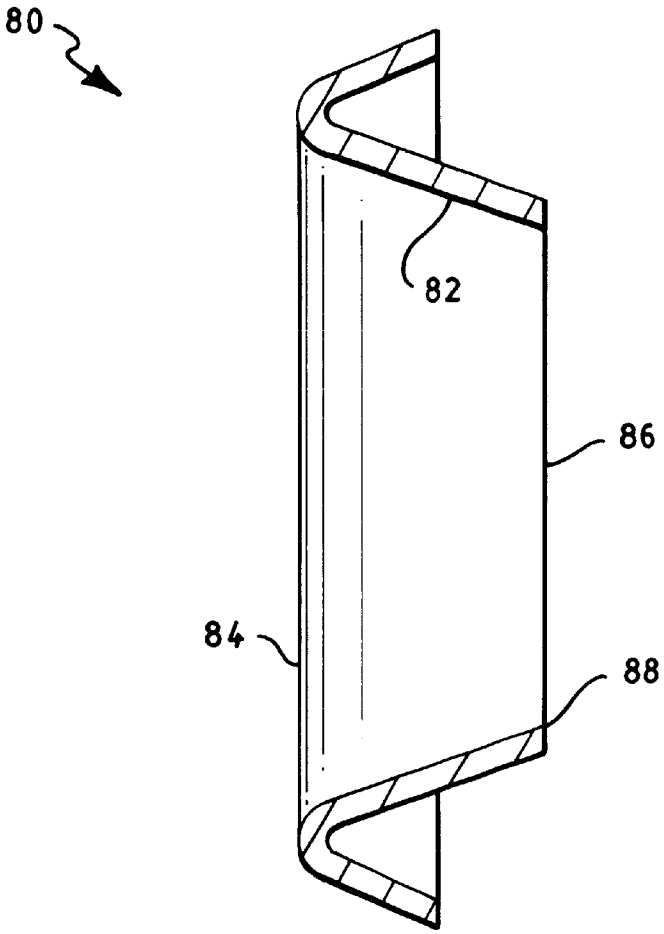
FIG. 4 shows a cross sectional view of a clamp ring.

FIG. 4 shows a cross sectional view of a preferred clamp ring 80. The clamp ring 80 may be made out of a harder material than the clamp arms 32, 34, 36. The preferred clamp ring 80 material is metal, but a ceramic or proper choice of plastic is equally possible. The preferred clamp ring 80 has the general form of a ring with a sloped interior surface 82 configured to mate with the exterior surfaces 62, 64, 66 of the clamp arms 32, 34, 36. The clamp ring 80 has an internal through passage sufficiently large to pass over the lamp capsule 12 and the free ends 38, 40, 42, but not so great as to pass over the attached ends 44, 46, 48. The interior surface 82 of the preferred clamp ring 80 is sloped with a sufficiently wide front end 84 to pass over the collective free ends 38, 40, 42, of the clamp arms 32, 34, 36, and a sufficiently narrow rear end 86 to compress, and thereby flex the clamp arms 32, 34, 36, into compressed contact with the lamp capsule 12 in the support region 26. In the preferred embodiment the clamp ring 80 includes a sharp trailing edge, barbs or other latching feature 88 to bite into the clamp arms 32, 34, 36 and thereby lock the clamp ring 80 to the clamp arms 32, 34, 36 when properly positioned. In one embodiment the clamp ring 80 had a circular form with a rolled back front edge and a small inside wall taper leading to a narrower rear edge forming a sharp corner sufficient to resist withdrawal back across the compressed clamp arms. It should be understood that an axially split ring could also be used, and such a configuration is considered an equivalent form of a clamp ring.

Figure 5:
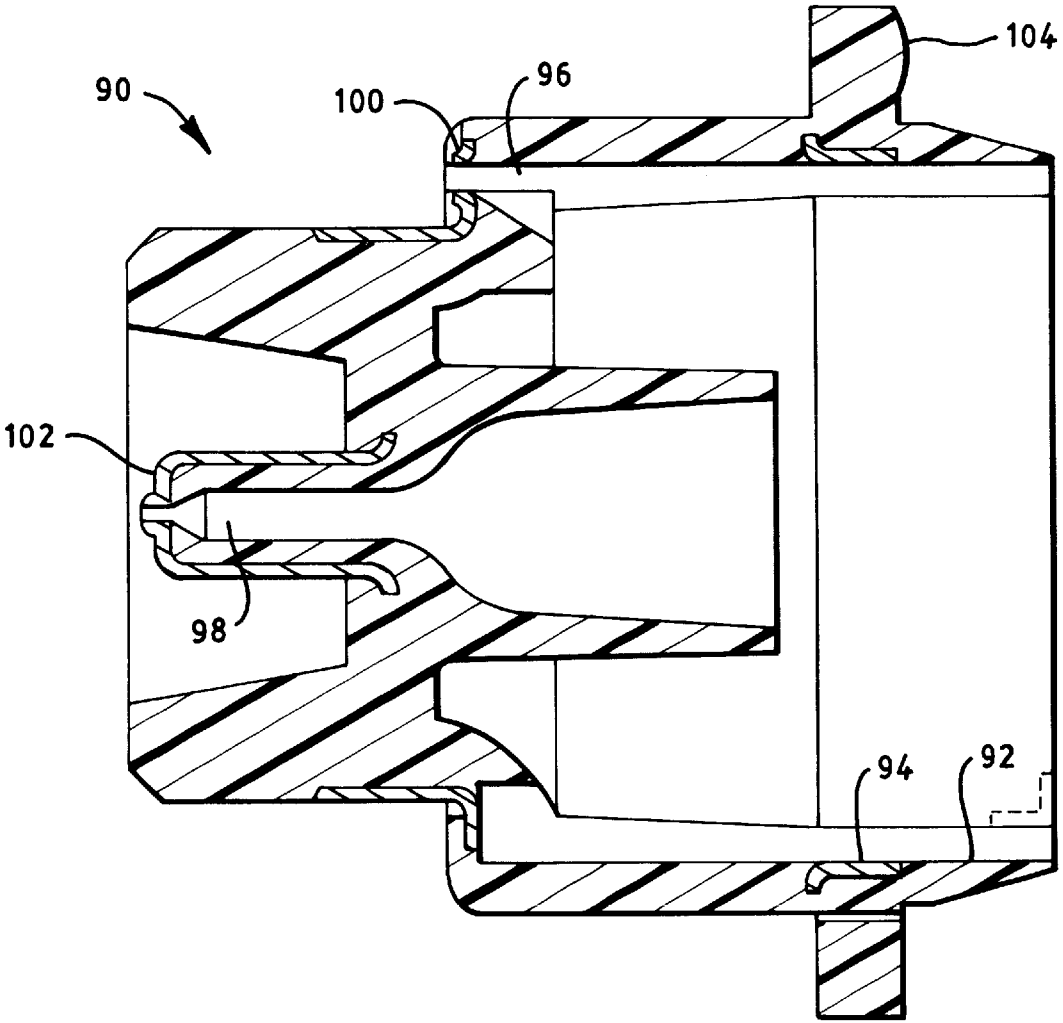
FIG. 5 shows a cross sectional view of a base.

FIG. 5 shows a cross sectional view of a base 90. In the preferred embodiment the envelope retainer 30 is held by a base 90. The base 90 has the general form of a cup to receive the envelope retainer 30, and may be molded from a resin material. The base 90 has an interior wall 92 with a coupling feature to contact and hold the envelope retainer 30. The coupling between the envelope retainer 30 and the base 90 is preferably adjustable to enable proper positioning of the lamp capsule 12 with respect to the base 90. In one embodiment, the envelope retainer 30 had an exterior metal ring forming a contact surface 76, while the base 90 had an interior metal ring 94 with a slightly larger diameter so the envelope retainer 30 could be positioned and an adjusted in the base 90, and the exterior ring 76 and the interior ring 94 could be welded one to the other once the proper lamp capsule 12 position was achieved. There are a variety of schemes known in the art for adjustably coupling an envelope retainer to a base most of which are believed to be adaptable for use with the clamp ring and clamp arm holding mechanism. The base 90 may further include lead passages, and electrical connection features to complete electrical connection for the lamp capsule, as generally known in the art. The preferred embodiment includes lead passages 96, 98 that end adjacent metal contacts 100, 102 so that the leads 16, 18 may be threaded through the passages 96, 98 and welded on the exterior to the contacts 100, 102. The base 90 may also further include sealing and positioning features as are generally known in the art. The preferred embodiment includes an exterior flange (rim) 104 providing a mating surface to couple the base 90 to a reflector.

To assemble the lamp, the lamp capsule 12 is advanced into the cavity formed by the clamp arms 32, 34, 36 until the lamp capsule 12 abuts the stop 58. The clamp ring 80 may then be advanced over the lamp capsule 12, and the free ends 38, 40, 42 of the clamp arms 32, 34, 36 to press the clamp arms 32, 34, 36 into intimate contact with the lamp capsule 12. When pressed over the conical exterior surface of the preferred clamp arms 32, 34, 36, the lead edge 84 presses into the clamp arms 32, 34, 36, thereby pressing the clamp arms 32, 34, 36 against the enclosed support region 26 to hold the lamp capsule 12 in place. At the same time the rear corner edge 88 catches the a re-expansion in the compressed clamp arms 32, 34, 36, and thereby resists removal of the clamp ring 80. When sufficient resistance pressure has been achieved in pressing the clamp ring 80 onto the tapered clamp arms 32, 34, 36, further advance is ended. A sheath 74 and lead extension are inserted into the coupling end 72. The lead extension is then welded to the second lead 18. The lamp capsule 12, envelope retainer 30 and clamp ring 80 assembly is then advanced into the base 90, taking care to thread the first lead 16, the second lead extension connector into their respective connector passages 98, 96. Electrical contact is then made between the first lead 16 and contact 102, and between the second lead extension and contact 100. The lamp is then lit. The lamp capsule 12, envelope retainer 30 and clamp ring 80 assembly is then adjusted with respect to the base 90, and when proper positioning is determined the exterior ring 76, and the interior ring 94 are welded in place to hold the lamp assembly in proper position.

In a working example some of the dimensions were approximately as follows: The lamp capsule was made of light transmissive quartz material in the form of a cylindrical tube. An outer jacket of hard glass was coupled to the lamp body, leaving a cylindrical skirt at one end for use as a locating region. The quartz inner tube was 5 mm diameter and 20 mm long. The outer jacket was 10 mm in diameter and 60 mm long. The retainer had three clamp arms defining a 10 mm diameter cavity. The clamp arms had a 5 degree taper expanding from the free ends to the attached ends. The clamp ring was made of a rolled piece of steal, having a round leading edge and square trailing edge with a sharp corner. The leading edge had a diameter of 15 mm, somewhat larger the diameter defined by the exterior walls of the clamp arms. The trailing edge had a diameter of 12 mm, somewhat less than the diameter defined by the exterior walls of the clamp arms. The inner wall of the clamp ring had a steeper slope than clamp arm taper. The clamp ring when advanced over the lamp skirt held in the clamp arms. The clamp ring compressed the clamp arms against the lamp skirt for a tight coupling when approximately centered midway along the tapered clamp arms. The squared trailing edge of the clamp ring was pressed into the compressible plastic of the clamp arms, which re-expanded after having been passed over by the trailing edge of the ring. The re-expanded portion then formed a block to the sharp tailing edge to resist with withdrawal or retreat of the clamp ring.

It should be understood that the support region 26 of the lamp capsule may have any convenient form, and similarly the clamp arm interior walls may have any convenient form, it is only important the lamp support region be able to nestle between the clamp arms in proper alignment, and the clamp arms be close enough, given their flexibility and length, to be flexed into contact with the support region 26 to support the lamp capsule accurately. similarly, the exterior surfaces of the clamp arms may have any convenient form, it is only important that when the exterior walls are subjected to compression to flex the clamp arms towards the support region. It is convenient that the lamp support region have a regular form (e.g. circular cylinder), and the interior surfaces have a corresponding conformal form (e.g. cylindrical) sufficient the mate the lamp support surface and the interior clamp surfaces. Other corresponding surfaces may be chosen to be mated. The disclosed dimensions, configurations and embodiments are as examples only, and other suitable configurations and relations may be used to implement the invention.

While there have been shown and described at are at present considered to be the preferred embodiments of the invention, it will be apparent to those skilled in the art that various changes and modifications can be made herein without departing from the scope of the invention defined by the appended claims.

What is claimed is:

1. A lamp with slip on envelope retainer and clamp ring comprising:

a) a lamp with an axially extending support region, b) an envelope retainer having at least one flexible clamp arm having an attached end and a free end and having an interior surface and an exterior surface, the lamp support region being positioned adjacent the interior surface of the clamp arm; the envelope retainer further includes an attachment surface to couple the envelope retainer to other locating and positioning components and c) a clamp ring, the clamp ring being a ring positioned around the support region of the lamp and the clamp arm of the envelope retainer, with an inner wall of the clamp ring pressing the exterior wall of clamp arm to press the interior wall of the clamp arm in contact with the support region to thereby clamp the lamp capsule to the envelope retainer.

2. The lamp in claim 1, wherein the clamp arm has a tapering thickness measured between the interior surface and the exterior surface increasing from the free end to the attached end.

3. The lamp in claim 1, wherein the clamp ring has a leading edge and a trailing edge with an inner wall having a narrowing interior diameter from the leading edge to the trailing edge.

4. The apparatus in claim 1, wherein the lamp capsule includes an enclosing outer envelope having a skirt portion extending from an first end of the lamp capsule, and the skirt portion provides the support surface.

5. The apparatus in claim 1, wherein the support region with a lamp surface has a regular axial extension.

6. The apparatus in claim 1, wherein the envelope retainer defines an interior cavity sized and shaped to conformally mate with the support surface of the lamp capsule.

7. The apparatus in claim 1, wherein the envelope retainer includes at least two clamp arms defining therebetween an interior cavity.

8. The apparatus in claim 1, wherein the interior surfaces of the clamp arms collectively define a circular, cylindrical cavity.

9. The apparatus in claim 1, wherein the clamp ring has an interior surface, sloped with respect to the axis.

10. The apparatus in claim 1, wherein the clamp ring has a forward end with a diameter greater than the exterior diameter of the free ends of the clamp arms, and a rear end with a diameter less than the exterior diameter of the attached ends of the clamp arms.

11. The apparatus in claim 1, wherein the envelope retainer includes a formed stop feature adjacent the clamp arms to abut an end portion of the lamp capsule to fix a proper insertion position of the lamp capsule with respect to the envelope retainer.

12. The apparatus in claim 11, where in the stop feature is an interior rib formed adjacent the attached ends of the clamp arms.

13. A lamp with slip on envelope retainer and clamp ring comprising:

a) a lamp having a first end, a second end, and a support region with a lamp surface, b) an envelope retainer, supporting the lamp and having at least two clamp arms, collectively defining therebetween a cavity, the clamp arms further having exterior surfaces collectively defining an exterior surface, and c) a clamp ring positioned around the clamps arm to press the clamp arms into compressed contact with the support region.

* * * * *